US010815161B2

(12) United States Patent
Weihs et al.

(10) Patent No.: US 10,815,161 B2
(45) Date of Patent: Oct. 27, 2020

(54) REACTIVE MATERIALS FOR MANIPULATING PROPAGATION RATES AND A RESULTING CHEMICAL TIME DELAY

(71) Applicant: THE JOHNS HOPKINS UNIVERSITY, Baltimore, MD (US)

(72) Inventors: Timothy P. Weihs, Baltimore, MD (US); Kyle Overdeep, Baltimore, MD (US)

(73) Assignee: The Johns Hopkins University, Baltimore, MD (US)

( * ) Notice: Subject to any disclaimer, the term of this patent is extended or adjusted under 35 U.S.C. 154(b) by 350 days.

(21) Appl. No.: 15/977,111

(22) Filed: May 11, 2018

(65) Prior Publication Data

US 2018/0327331 A1 Nov. 15, 2018

Related U.S. Application Data

(60) Provisional application No. 62/504,581, filed on May 11, 2017.

(51) Int. Cl.

| | |
|---|---|
| ***C06B 45/00*** | (2006.01) |
| ***C06C 5/06*** | (2006.01) |
| *C06B 45/12* | (2006.01) |
| *C06B 45/14* | (2006.01) |
| *D03D 23/00* | (2006.01) |
| *D03D 43/00* | (2006.01) |

(52) U.S. Cl.

CPC ..... *C06C 5/06* (2013.01)

(58) Field of Classification Search

USPC ..... 149/2, 14, 15, 108.2, 109.4

See application file for complete search history.

(56) References Cited

U.S. PATENT DOCUMENTS

| | | | | |
|---|---|---|---|---|
| 5,538,795 | A | 7/1996 | Barbee, Jr. et al. | |
| 5,547,715 | A * | 8/1996 | Barbee, Jr. | C06B 45/14 427/404 |
| 6,736,942 | B2 * | 5/2004 | Weihs | B23K 20/06 204/192.12 |
| 6,991,856 | B2 | 1/2006 | Weihs et al. | |

(Continued)

OTHER PUBLICATIONS

Jayaraman et al., Numerical Study of the Effect of Heat Losses on Self-Propagating Reactions in Multilayer Foils, Combust. Flame, 124,178-194, (2001).

(Continued)

*Primary Examiner* — James E McDonough

(74) *Attorney, Agent, or Firm* — Johns Hopkins Technology Ventures

(57) ABSTRACT

The present invention is directed to embodiments of reactive material (RM) and an associated chemical time delay that includes an RM, according to an embodiment of the present invention. One embodiment includes a delay material that is an RM patterned on a substrate using lithographic techniques. Another embodiment includes a delay material that is an RM deposited on a patterned substrate such as a mesh. The present invention also includes a chemical time delay that includes either embodiment of the delay material, or any variation on the delay material that would be known to or conceivable to one of skill in the art.

30 Claims, 27 Drawing Sheets

(56) References Cited

U.S. PATENT DOCUMENTS

| | | | | |
|---|---|---|---|---|
| 8,431,197 | B2 * | 4/2013 | Fritz | B32B 1/08 428/323 |
| 9,382,167 | B2 | 7/2016 | Fritz et al. | |
| 2002/0182436 | A1 * | 12/2002 | Weihs | C04B 37/006 428/635 |

OTHER PUBLICATIONS

Gavens et al., Effect of Intermixing on Self-Propagating Exothermic Reactions in Al/Ni Nanolaminate Foils, J. Appl. Phys., 87, 1255-1263, (2000).

Fritz et al., Thresholds for Igniting Exothermic Reactions in Al—Ni Multilayers with Local Pulses of Electrical and Mechanical Energy, J. Appl. Phys., 113, 014901 (2013).

Fritz et al., Enabling and Controlling Slow Reaction Velocities in Low-density Compacts of Multilayer Reactive Particles, Combustion and Flame, 158, 1084-1088, 101016 (2011).

* cited by examiner

REACTIVE MATERIALS FOR MANIPULATING PROPAGATION RATES AND A RESULTING CHEMICAL TIME DELAY

CROSS REFERENCE TO RELATED APPLICATIONS

This application claims the benefit of U.S. Provisional Patent Application No. 62/504,581 filed on May 11, 2017, which is incorporated by reference, herein, in its entirety.

FIELD OF THE INVENTION

The present invention relates to reactive materials. More particularly the present invention relates to reactive materials developed for manipulating propagation rates.

BACKGROUND OF THE INVENTION

Self-propagating, exothermic reactions in powder compacts are commonly used as chemical time delays, but the performance of these delays is limited and environmentally hazardous materials such as lead oxide are often used. Vapor-deposited reactive materials (RMs) offer an alternative, environmentally friendly source for self-propagating reactions, but their propagation velocities are typically too high.

It would therefore be advantageous to provide a patterned RM with controlled discontinuities.

BRIEF DESCRIPTION OF THE FIGURES

FIG. 18A shows a 50 μm mesh, which propagated at 1.3 mm/s. FIG. 18A shows a 75 μm mesh, which propagated at 0.9 mm/s. FIG. 18C shows a 100 μm mesh, which did not propagate.

FIG. 24A shows propagation in the perpendicular direction, at 2.5 mm/s. FIG. 24B shows propagation in the diagonal direction, at 2.9 mm/s.

SUMMARY

Figure 1:
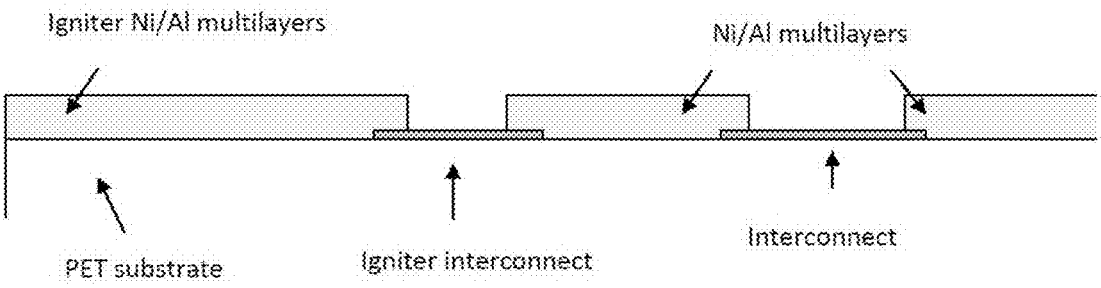
FIG. 1 illustrates a schematic view of a structure of a base model, according to an embodiment of the present invention.

The foregoing needs are met, to a great extent, by the present invention, wherein in one aspect a material for manipulating propagation rates of an exothermic reaction includes a reactive material, wherein the reactive material is configured for discontinuous propagation.

In accordance with an aspect of the present invention, patterned breaks are connected by an inert material. A tube can be included that is sealed at both ends. The reactive material is reacted within the tube. A thickness of the reactive material is varied to manipulate the propagation rate.

In accordance with an aspect of the present invention, a material for manipulating propagation rates of an exothermic reaction includes a reactive material, wherein the reactive material has discontinuities. The discontinuities have patterned breaks between a first segment of the reactive material and a subsequent segment of the reactive material. The patterned breaks are patterned lithographically.

In accordance with another aspect of the present invention, patterned breaks are connected by an inert material. A tube can be included that is sealed at both ends. The reactive material is reacted within the tube. A thickness of the reactive material is varied to manipulate the propagation rate.

In accordance with another aspect of the present invention, a material for manipulating propagation rates of an exothermic reaction includes a reactive material, wherein the reactive material have discontinuities. The discontinuities include patterned breaks between a first segment of the reactive material and a subsequent segment of the reactive material. The patterned breaks are patterned mechanically.

In accordance with another aspect of the present invention, patterned breaks are connected by an inert material. A tube can be included that is sealed at both ends. The reactive material is reacted within the tube. A thickness of the reactive material is varied to manipulate the propagation rate.

In accordance with yet another aspect of the present invention, a device for manipulation of propagation rates of an exothermic reaction includes a substrate. The device also includes a reactive material reacted on the substrate. The reactive material includes discontinuities. The discontinuities include breaks between a first segment of the reactive material and a subsequent segment of the reactive material. The breaks are patterned lithographically.

In accordance with another aspect of the present invention, patterned breaks are connected by an inert material. A tube can be included that is sealed at both ends. The reactive material is reacted within the tube. A thickness of the reactive material is varied to manipulate the propagation rate. The substrate can have a low thermal conductivity.

In accordance with still another aspect of the present invention, a device for manipulation of propagation rates of an exothermic reaction includes a substrate. The device also includes a reactive material reacted on the substrate. The reactive material includes discontinuities. The discontinuities include breaks between a first segment of the reactive material and a subsequent segment of the reactive material. The breaks are patterned mechanically.

In accordance with another aspect of the present invention, patterned breaks are connected by an inert material. A tube can be included that is sealed at both ends. The reactive material is reacted within the tube. A thickness of the reactive material is varied to manipulate the propagation rate. The substrate can have a low thermal conductivity.

In accordance with yet another aspect of the present invention, a device for manipulation of propagation rates of an exothermic reaction includes a substrate. The substrate includes a mesh in which the weave produces discontinuities of the exposed surfaces of the mesh. The device includes a reactive material reacted on the substrate, wherein propagation through the reactive material is discontinuous as a result of holes in the mesh.

In accordance with another aspect of the present invention, patterned breaks are connected by an inert material. A tube can be included that is sealed at both ends. The reactive material is reacted within the tube. A thickness of the reactive material is varied to manipulate the propagation rate. The substrate can have a low thermal conductivity. The substrate's thermal conductivity is varied to tune the propagation through the reactive material. The substrate's heat capacity is varied to tune the propagation through the reactive material. The substrate's thickness (wire thickness) is varied to tune the propagation through the reactive material. The substrate can take the form of a polymer mesh.

DETAILED DESCRIPTION OF THE PREFERRED EMBODIMENTS

The presently disclosed subject matter now will be described more fully hereinafter with reference to the accompanying Drawings, in which some, but not all embodiments of the inventions are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

The present invention is directed to embodiments of reactive material (RM) and an associated chemical time delay that includes an RM, according to an embodiment of the present invention. One embodiment includes an RM patterned using lithographic techniques, while another embodiment of the RM includes patterning using mechanical techniques. Another embodiment includes a delay material, or a device for manipulation of propagation rates, that is an RM deposited on a substrate. In this embodiment the substrate can take the form of a solid substrate or a discontinuous substrate, such as a mesh. Discontinuities are created in the RM either by patterning the RM on the substrate, preferably a solid substrate, or by depositing the reactive material on a discontinuous substrate, such as a mesh. Manipulation of propagation rates is possible through control of the discontinuities in the RM, discontinuities in the substrate, RM thickness, substrate patterning, and any other factors known to or conceivable to one of skill in the art. Interruption of propagation leads to slowing of propagation rates in delay devices. The present invention also includes a chemical time delay device that includes either embodiment of the RM, or any variation on the delay material that would be known to or conceivable to one of skill in the art.

With respect to one embodiment of the delay material, the invention includes an RM with controlled discontinuities in the RM where thermal transport is not determined by thermal contact resistance. These discontinuities are patterned breaks between segments of RMs that are connected by an inert material such as Al on a continuous substrate with low thermal conductivity. Such breaks can be patterned lithographically. A Finite Element Method (FEM) can be applied to predict heat conduction in the structure under varying geometric and thermophysical conditions. At least three variables can be altered to control the time and performance of the delays: the heat transfer efficiency between the reacting and unreacted material, the ignition temperature for the RM, and the average propagation velocity within the continuous reactive segments. The heat transfer efficiency must be high enough (>35%) to ensure that the exothermic, chemical reactions in the delays can self-propagate and not quench. One must balance a trade-off between the length of the time delay and the efficiency of the heat transfer for all geometric and thermal-physical parameters except the height of the reactive film.

The novelty of the delay material, when it takes the form of an RM patterned on a substrate using lithographic techniques is the design, creation, and use of a periodic structure in which small segments of RM are separated from each other to produce a chemical time delay with a reproducible and controlled time delay ranging from 100's of microseconds to 10's of seconds for a given length, such as chemical time delays with a length range of 0.25 inches to 2.0 inches. An exothermic reaction propagates through this structure by one segment reacting and getting hot, heating an adjoining segment to a pre-designed ignition temperature, and then repeating this three-step sequence of reacting, heating, and ignition. The final structure, its application, and its controllable design are unique.

In an exemplary implementation of the RM patterned on a substrate using lithographic techniques, Abaqus Finite Element Analysis (FEA) software was used to simulate uncoupled heat transfer in the time delay. This exemplary implementation is meant to be illustrative, and is not to be considered limiting. Any implementation of the present invention, known to or conceivable to one of skill in the art could also be employed. 8 node linear brick heat transfer elements (DC3D8) were used in the model. The structure was created from twenty alternating units of reactive Ni/Al multilayer sections and Al interconnects on a PET substrate, but the simulation was run until the eighth reactive material (RM) section ignited to avoid edge effects. The properties in the Ni/Al sections are given values based on the volume averaged properties of multilayers. Thermal conductivity in the Ni/Al multilayers is assumed to be orthotropic. FIG. 1 illustrates a schematic view of a structure of a base model, according to an embodiment of the present invention. As shown in FIG. 1, the sections of reactive material in the base model are 250 μm long, 40 μm thick, and have 50 μm of overlap with the Al interconnects. The Al interconnects are 1 μm thick and 160 μm long including the overlap with the RM sections. The first reactive materials section and the first interconnect, though have lengths of 350 μm and 150 μm, respectively. The substrate is 120 μm thick and 3240 μm long.

Figure 2:
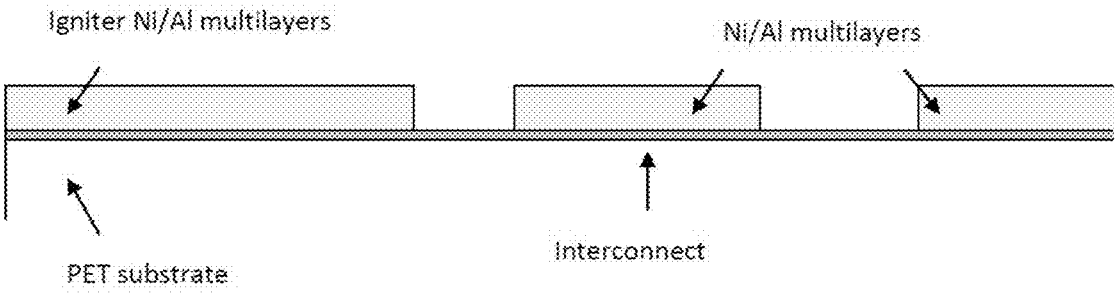
FIG. 2 illustrates a schematic view of a structure of the model with a continuous interconnect.

Because the time delay is typically ignited using a shock wave, the first RM section is given a longer length than the other sections to avoid accidental ignition of multiple sections and to encourage ignition of the following section which lacks initial preheating. FIG. 2 illustrates a schematic view of a structure of the model with a continuous interconnect. As shown in FIG. 2, the first RM section (the igniter section) has a length of 350 μm, and the Al interconnect is continuous. In addition, because the first RM section is assumed to be ignited at the start of the simulation, it is assigned the properties of the NiAl intermetallic. During the simulations, small oscillations in temperature were reduced by setting the time step such that $$\Delta t > \frac{\rho C_p}{6k}\Delta l^2 \tag{1}$$

where Δt is the time step, Δl is the element length, ρ is the density, $C_p$ is the heat capacity, and k is the thermal conductivity. Aside from ensuring that the time step was sufficiently large given the element length, the effect of element size was not checked. Several assumptions are made in the model. No heat loss occurs at the boundary of the model, and material properties are considered temperature independent. The reaction in the Ni/Al multilayers is assumed to be both instantaneous along the length of the material and purely a solid-solid reaction. Ignition is said to occur when a node in the unreacted material reaches 600 K, which was shown to be the ignition temperature of vapor-deposited multilayers. When ignition occurs the temperature of the section is set to 1800 K. The structure is designed to be vapor-deposited so gap conductance is given ideal thermal conductivity.

In performing the parametric study, five geometrical parameters are varied and one thermophysical property is varied relative to the base model. The Al interconnect thickness is varied from 0.1 μm to 1.5 μm; the interconnect length is varied from 140 μm to 170 μm in 5 μm increments; the RM thickness is varied from 20 μm to 50 μm in 5 μm increments; the RM length is varied from 150 μm to 400 μm in 50 μm increments; and the substrate thickness is varied from 0 μm to 280 μm; and lastly, the thermal conductivity of the interconnect is varied from 150 W/mK to 400 W/mK. In the simulations where thickness is changed, all parts of that type (eg. RM sections) are altered, while in simulations where length is changed, unless stated otherwise, only the sections after the first RM section are affected. The amount of overlap between the RM and interconnect was also varied and was found to have no effect on the time delay. In addition, as an alternative geometry, the alternating Al interconnects shown in FIG. 1 are replaced by a continuous Al interconnect on the substrate as shown in FIG. 2.

Three criteria were used to evaluate the performance of the model: the average time to ignite the next section, the average efficiency of the hot RM igniting the unreacted RM, and the velocity of the entire simulation. The equation for efficiency is given by:

$$Eff = 1 - \frac{T_2}{T_1} \tag{2}$$

where $T_2$ is the temperature of the temperature of the leading node adjacent to the interconnect in the unreacted material and $T_1$ is the temperature of the node at the upper right corner of the RM section that precedes and therefore heats the unreacted section. The efficiency parameter provides a metric for how much of the heat from the proceeding RM section must be transferred to the next RM section to enable ignition.

Figure 3A:
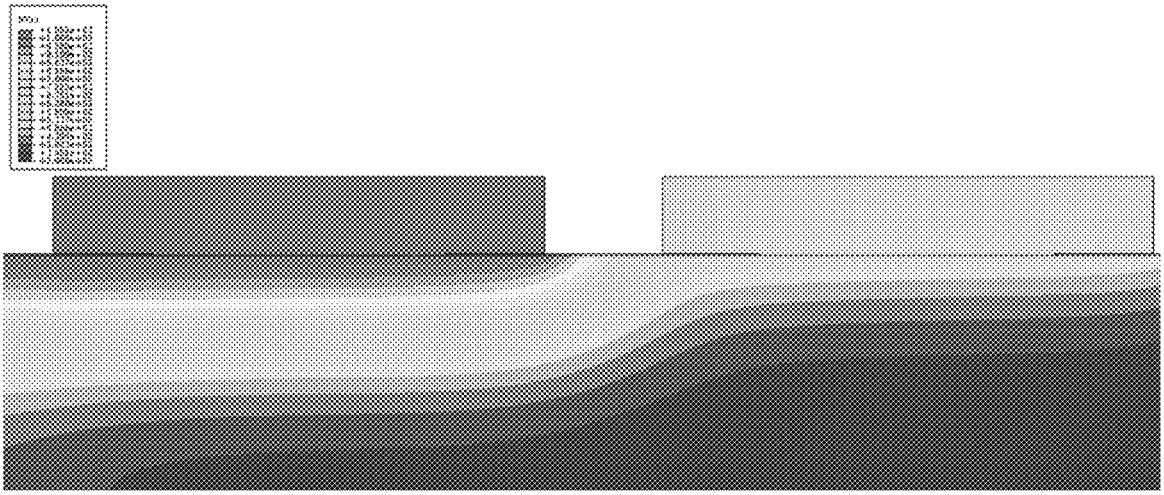
FIGS. 3A and 3B illustrate temperature profiles of propagating systems.
Figure 3B:
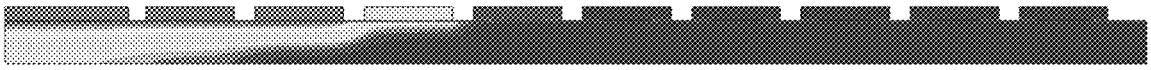

When the simulation begins, the substrate and interconnect near the hot material are heated very rapidly to a uniform temperature near their interface due to perfect interface conductivity. Heat transfer along the length of the structure in the interconnects and RM sections is accompanied by a relatively shallow heating of the substrate underneath, as shown by the temperature profiles in FIGS. 3A and 3B. FIGS. 3A and 3B illustrate temperature profiles. FIG. 3A illustrates a zoomed in temperature profile of the hot $3^{rd}$ reacted section and the $4^{th}$ unreacted section immediately before ignition. FIG. 3B illustrates a temperature profile of the entire model immediately prior to the ignition of the $4^{th}$ unreacted section.

These profiles depict the temperature distribution within the base model at the time when the fourth RM section ignites. The temperature variation across the unreacted section shown is small, less than 100 K along its length. Some preheating occurs in the substrate and the next unreacted RM section. In the case of FIGS. 3A and 3B, this refers to the fifth RM section. The reacted RM sections that lie behind the reaction front remain hotter than the Ni/Al ignition temperature for the course of the simulation, due to the low thermal conductivity of the substrate and the lack of radiative and convective heat loss.

Figure 4:
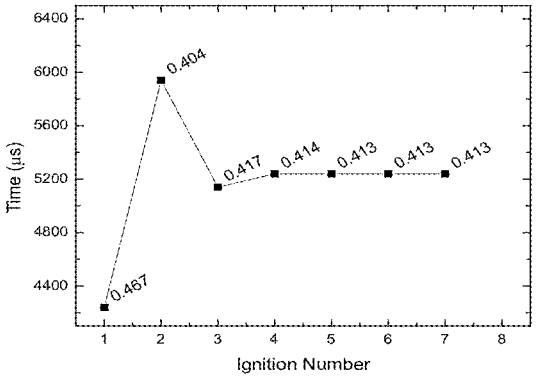
FIG. 4 illustrates a graphical view of ignition time for each section in the base model. The labels indicate the efficiency of each section.
Figure 5:
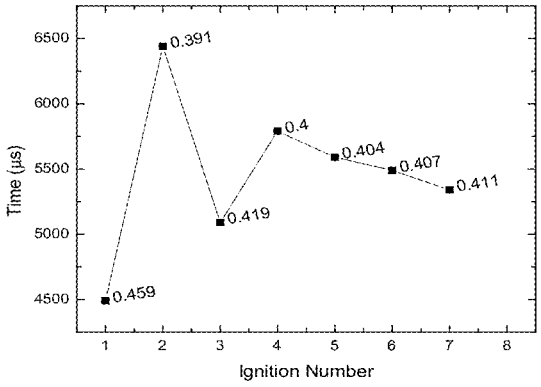
FIG. 5 illustrates a graphical view of ignition time for each section in the continuous interconnect model. The labels indicate the efficiency of each section.
Figure 6:
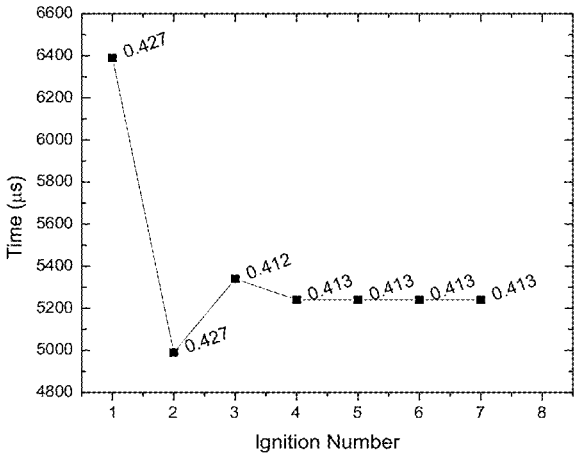
FIG. 6 illustrates a graphical view of ignition time for each section in the equal interconnect length model. The labels indicate the efficiency of each section.
Figure 7:
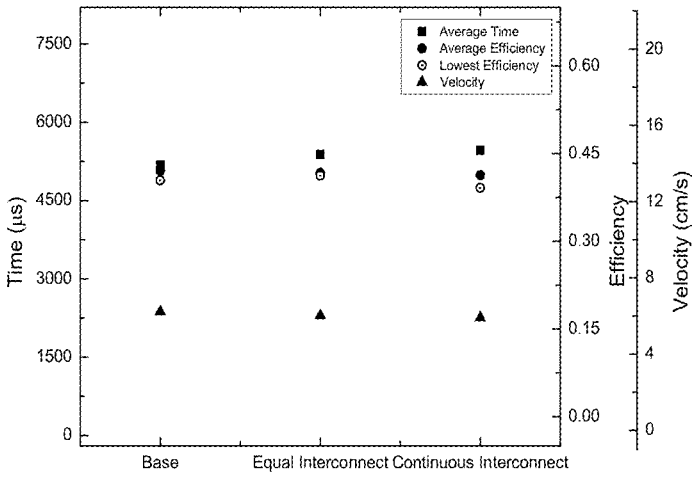
FIG. 7 illustrates a graphical view showing that the average times, efficiencies, and propagation velocities of all three geometries are roughly equal.

FIG. 4 illustrates a graphical view of the increment in time needed to enable ignition of each segment in the base model following first heating. We refer to this increment in time as the ignition time for each section in the base model. Labels indicate the efficiency of the heat transfer for the ignition. FIG. 5 illustrates a graphical view of ignition time for each section in the continuous interconnect model. Labels indicate the efficiency for that run. FIG. 6 illustrates a graphical view of ignition time for each section in the equal interconnect length model. Labels indicate the efficiency for that run. In FIGS. 4-6 the time and the efficiency of seven sequential ignition events in a given time delay are reported for three different interconnect geometries. FIG. 4 shows the data for the base model where the first interconnect is 150 μm long but all other interconnects are 160 μm long. The ignition time is shortest for the first ignition event and longest for the second ignition events. A drop in the ignition time is observed at the third event before rising towards an equilibrium ignition time of 5.24 ms. A comparable but inverse behavior is exhibited in the efficiency of each ignition, where the first ignition has the highest efficiency and the second ignition has the lowest. When the discontinuous interconnect is replaced with a continuous interconnect of Al the time and efficiency behavior is similar to that of the base model as shown in FIG. 5. The major difference is that instead of reaching a constant value following the initial oscillations, the ignition time decreases at a linear rate while the efficiency increases at a linear rate. The ignition time for the seventh ignition event was 5.34 ms in this case. When the Al interconnects all have the same 160 μm length, including the first interconnect, the first ignition event is much longer in time than the following ignitions, as shown in FIG. 6. Note, however, that the first two ignition events have relatively high efficiencies. The average ignition time, reaction velocity, and efficiency for all seven ignition events are plotted in FIG. 7 and are close for all three cases with values of approximately 5.34 ms, 6.06 cm/s, and 0.417, respectively. FIG. 7 illustrates graphically that the average ignition times, reaction velocities, and efficiencies of all three geometries are roughly equal.

Figure 8:
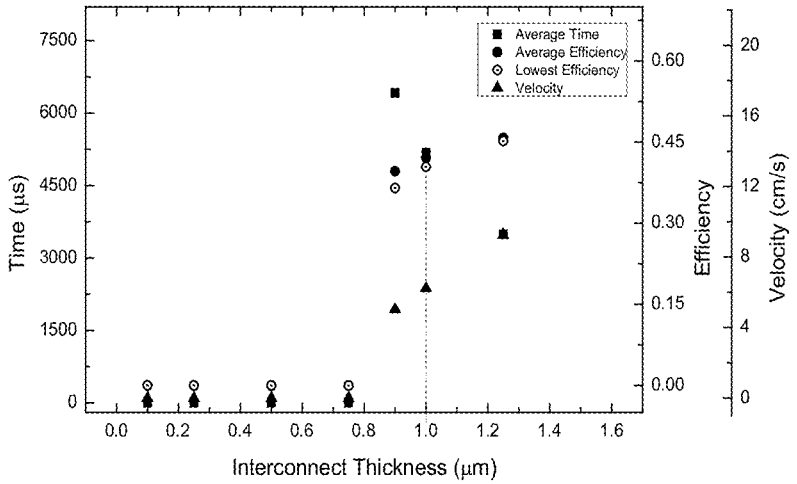
FIG. 8 illustrates a graphical view of average time, efficiency, and reaction velocity as a function of interconnect thickness.

FIG. 8 illustrates a graphical view of average time, efficiency, and reaction velocity as a function of interconnect thickness. The drop line indicates the base model values. The lowest efficiency for a single ignition in the case of complete propagation is 0.365. FIG. 8 is a compilation of average ignition times and efficiencies when the Al interconnect thickness is varied 0.1 μm to 1.5 μm. When the interconnect thickness is below 0.75 the reaction quenches after the first ignition event and fails to propagate further. The reaction quenches after the second ignition event when the interconnect thickness is below 0.9 μm. The reactions could propagate continuously and enable all ignition events for all other interconnect thicknesses. However, for the 0.9 μm thick interconnect, the lowest efficiency for a single ignition event was achieved: 0.365. This suggests that 0.365 may be a lower boundary of efficiency for complete propagation. Increasing the interconnect thickness above 0.9 μm is shown to increase efficiency from 0.396 to 0.479 and decrease the ignition time from 6.42 ms to 2.58 ms. It is interesting to note that the 0.9 μm thick interconnect exhibited the lowest velocity of all simulations with a value of 5.03 cm/s.

Figure 9:
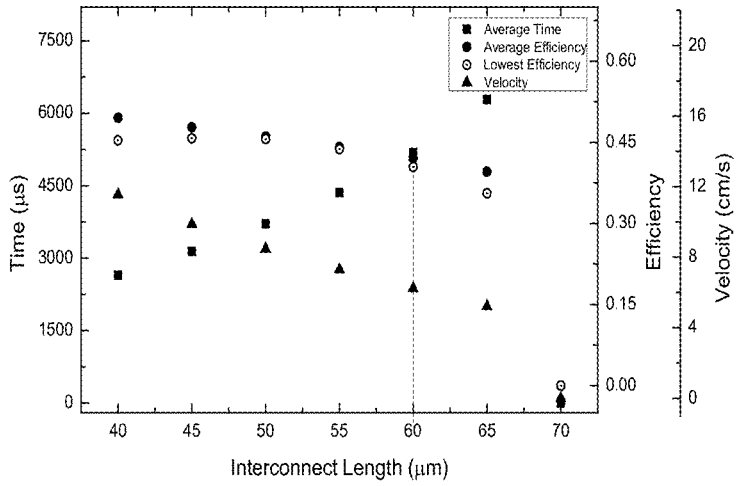
FIG. 9 illustrates a graphical view of average time, efficiency, and reaction velocity as a function of interconnect length variations.

The length of all interconnects beyond the first one was varied from 140 μm to 170 μm in 5 μm increments and data from the simulations are shown in FIG. 9. FIG. 9 illustrates a graphical view of average time, efficiency, and reaction velocity as a function of interconnect length variations. The cutoff efficiency is 0.355. Data for the base model are indicated with a drop line. As the interconnect length increases, average ignition time is shown to increase while velocity and average efficiency decrease. The lowest efficiency before the simulation failed to completely propagate was 0.355. The average ignition times ranged from 2.65 ms to 6.28 ms and the average efficiency ranged from 0.396 to 0.495. The 170 μm interconnect failed to propagate past the second ignition event.

Figure 10:
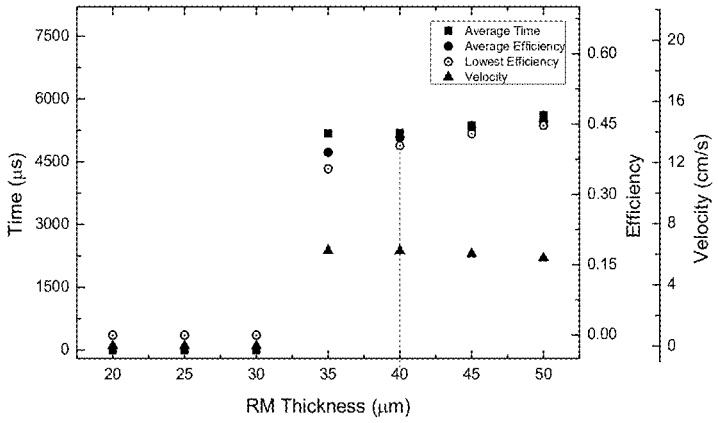
FIG. 10 illustrates a graphical view of average time, efficiency, and reaction velocity as a function of RM thickness variations.

The RM thickness is the only parameter for which the average time, average efficiency, and average velocity all increase or remain relatively constant as the parameter increases, as seen in FIG. 10. FIG. 10 illustrates a graphical view of average time, efficiency, and velocity as a function of the RM thickness. The drop line indicates the base model values. The cutoff efficiency is 0.354. The average ignition time ranged from 5.18 ms to 5.61 ms, and the average efficiency varied from 0.390 to 0.456. The 35 μm thickness has the lowest efficiency for a single ignition event (0.354) for all the thicknesses that enabled the reaction to propagate the full length of the model. The 35 μm thick sample also has the lowest average efficiency for this group with a value of 0.390. A greater dependence of average time, average efficiency, and average velocity are likely to be seen if heat losses from the RM to the surrounding environment are considered.

Figure 11:
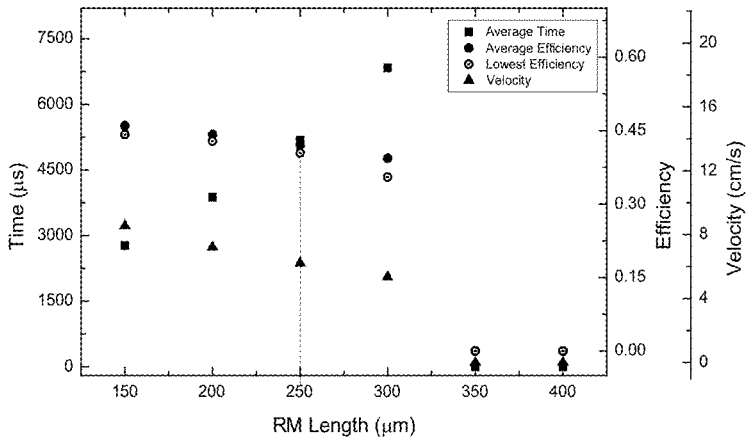
FIG. 11 illustrates a graphical view of average time, efficiency, and reaction velocity as a function of RM length variations.

FIG. 11 compiles the results of the RM length variations. The average ignition time ranges from 2.77 ms to 6.83 ms, and the average efficiency ranges from 0.460 to 0.394. Both the 350 μm and 400 μm simulations failed to ignite the first section, and the 300 μm simulation had the lowest efficiency (0.355) for a single ignition event. Average ignition time trends upward with increasing RM length and average efficiency and velocity trend downward. FIG. 11 illustrates a graphical view of average time, efficiency, and velocity of the RM length variations. The cutoff efficiency is 0.355.

Figure 12:
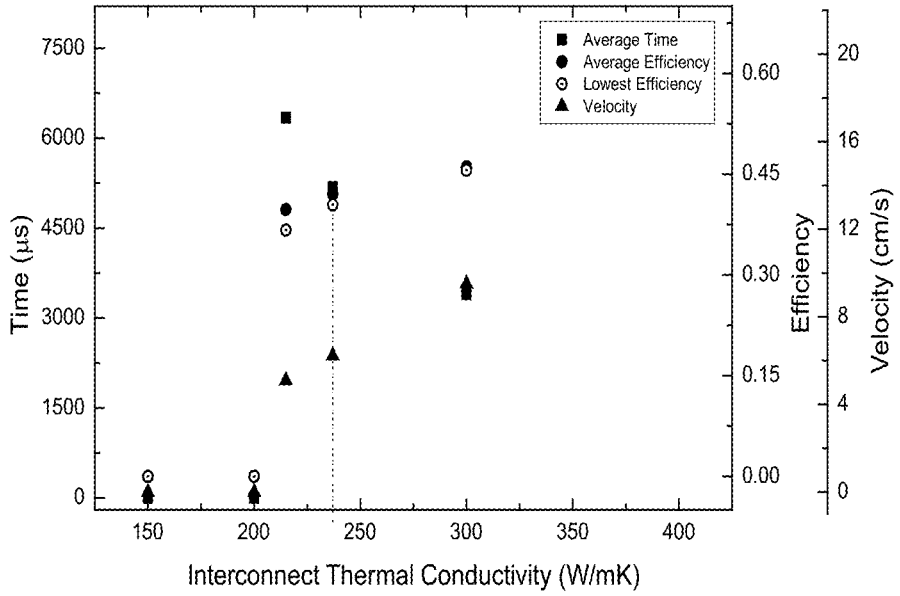
FIG. 12 illustrates average time, efficiency, and reaction velocity as a function of thermal conductivity variations.

The results of the thermal conductivity variations are shown in FIG. 12. FIG. 12 illustrates average time, efficiency, and velocity as a function of the thermal conductivity variations. The drop line indicates the base model values. The cutoff efficiency was 0.367. Average ignition times varied from 6.34 ms to 2.09 ms. Average efficiency ranged from 0.397 to 0.498. Both the 150 W/mK and 200 W/mK variations failed to propagate past the second ignition event. The 215 W/mK variation had the lowest efficiency (0.367) for conductivities that enabled complete propagation.

Figure 13:
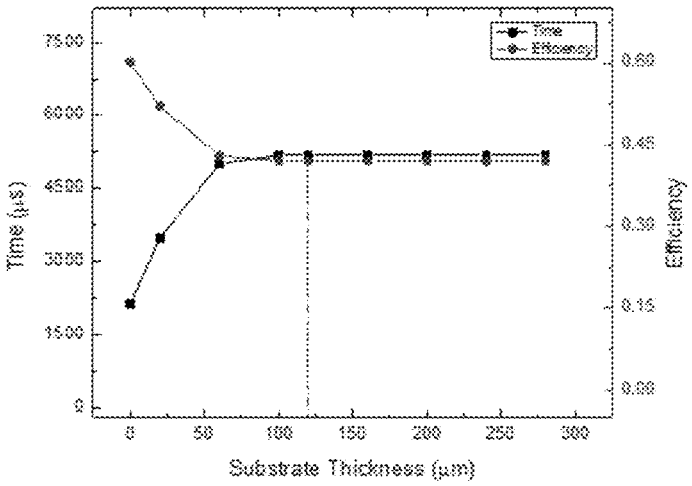
FIG. 13 illustrates a graphical view of average time, efficiency, and reaction velocity as a function of substrate thickness variations.

The substrate thickness was varied to ensure that its thickness did not affect average ignition times or average efficiencies. Average ignition times and average efficiencies are plotted in FIG. 13 and are seen to be independent of substrate thicknesses for values greater than 100 μm. FIG. 13 illustrates a graphical view of average time, efficiency, and velocity as a function of the substrate thickness variations. The drop line indicates the base model values.

Figure 14:
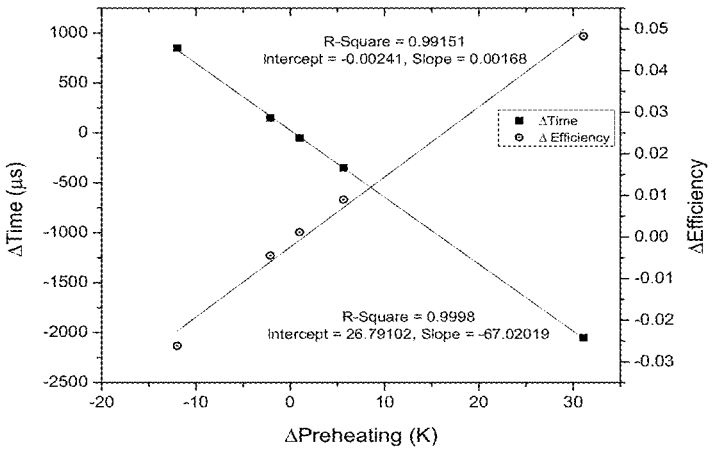
FIG. 14 illustrates strong, linear correlations between changes in ignition time and efficiency and changes in the amount of preheating in an unreacted section.
Figures 15A, 15B, 15C, 15D, 15E:
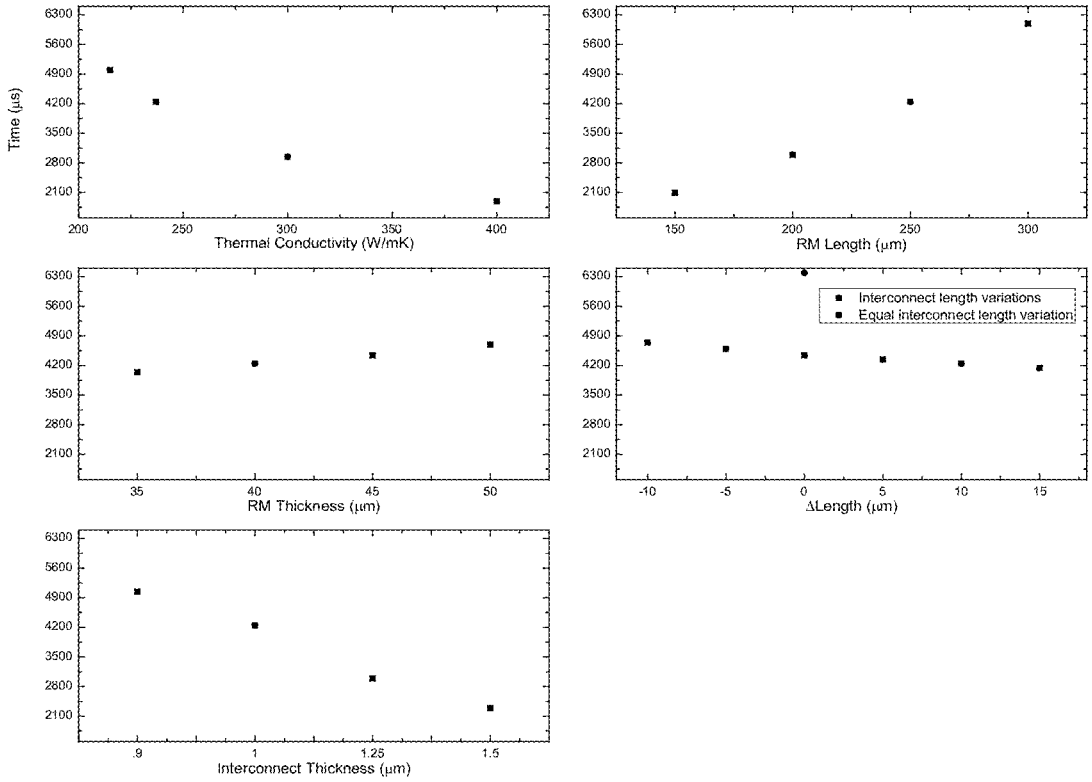
FIGS. 15A-15E illustrate graphical views of initial ignition time plotted against interconnect thermal conductivity in FIG. 15A, RM length in FIG. 15B, RM Height in FIG. 15C, length difference between the interconnect and igniter interconnect in FIG. 15D and interconnect height in FIG. 15E.

The results above have shown how variations in parameters affect the average ignition time and efficiency of a patterned, thin film chemical time delay. FIG. 14 illustrates strong linear correlations between changes in ignition time and efficiency and changes in the amount of preheating in an unreacted section. FIG. 14 illustrates a graphical view of a scatterplot of the change in preheating verse changes in efficiency and ignition time with linear fits for the 35 μm RM thickness variation. FIGS. 15A-15E illustrate graphical views of initial ignition time plotted against interconnect thermal conductivity in FIG. 15A, RM length in FIG. 15B, RM thickness in FIG. 15C, length difference between the interconnect and igniter interconnect in FIG. 15D and interconnect thickness in FIG. 15E. FIG. 15D includes the equal interconnect length variation to compare global increases in interconnect length. Linear fits were only calculated for the 35 μm RM thickness, 0.9 μm interconnect thickness, and 300 μm RM length variations due to changes in the ignition time quickly falling below the resolution of the time step in other variations and providing insufficient data points. How different factors play a role in determining ignition time, independent of preheating, can be determined by comparing only the first ignition time in sets of variations shown in FIGS. 15A-15E. Altering the thickness, length, or thermal conductivity of the igniter interconnect alters different parts of the interconnect thermal resistance given in the equation $$R = \frac{L}{kA} \tag{3}$$

where L is the length of the resistor, k is the thermal conductivity, and A is the cross-sectional area. As expected, variations that increase the thermal resistance also increase the ignition time. FIG. 15D plots the change in ignition time as a function of the difference in length between the interconnects and the igniter interconnect. Increasing the length of the interconnects relative to the igniter interconnect increases the thermal resistance to heat flowing out of the unreacted section, helping to trap heat in the unreacted section and decrease the ignition time.

Looking at the results presented, none of the sets of variations are able to propagate at efficiencies less than approximately 35.5%. This suggests that for an ignition temperature of 600 K, a hot section must be at least 930 K. This indicates the point where the sum of heat flows into and out of the unreacted section are equal to 0. At temperatures below 930 K in the hot section, more heat flows out of the unreacted section than into it, halting any further increase in temperature. This minimum efficiency puts a hard boundary on the usable geometric and thermophysical parameters.

Figure 16:
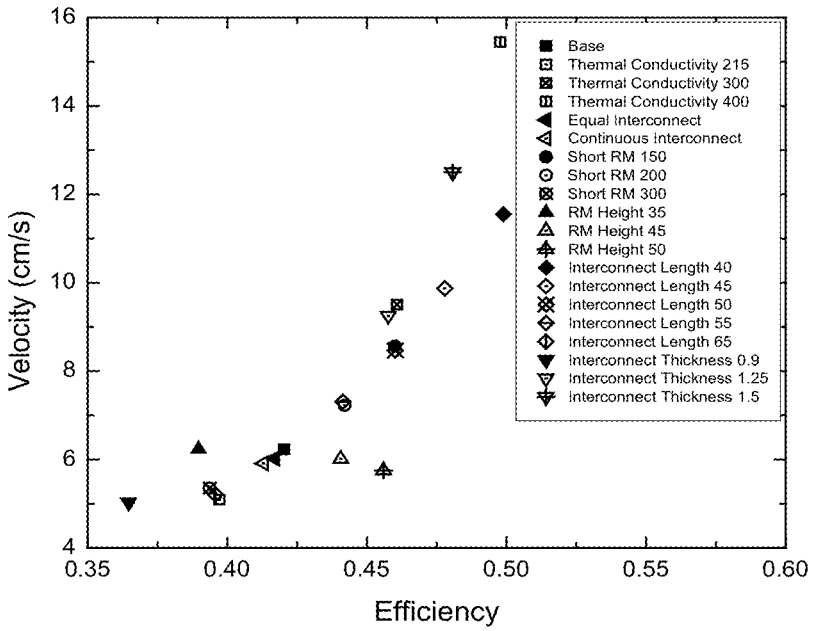
FIG. 16 illustrates a graphical view of reaction velocity as a function of efficiency, geometrical, and physical property variations.

A comparison of the propagation velocities and the average efficiencies of the simulations is presented in FIG. 16. FIG. 16 illustrates a graphical view of reaction velocity as a function of efficiency, thermal conductivity, and RM and interconnect geometry. The predicted propagation velocities range from 5.03 cm/s to 15.45 cm/s and are desirable for use in a chemical time delay. A broader range of velocities could be obtained with RMs that have different properties such as reaction heats or ignition thresholds.

An inverse relationship exists for most of the parameter variations between decreasing velocity and increasing efficiency, while not limiting the potential for optimization, necessitates the consideration of both efficiency and ignition. An efficiency close to 35% is undesirable, the preferred efficiency being close to 45-50% to offset radiative and convective heat losses and to allow for variability in ambient temperature. In such cases, a decrease in ignition time is an acceptable cost. The tradeoff between efficiency and ignition time is not observed in RM thickness variations, though, because depositing multilayers greater than 50 μm is time consuming and expensive. One of the possible methods to circumvent the RM thickness limit is to replace the Ni/Al with another system that has a higher heat of reaction and a solid intermetallic product such as Nb/2B, Zr/C, or Ti/C.

Referring to FIG. 11, an inverse correlation between increasing RM length and velocity is observed in the RM length model. This is due to the increased thermal resistance in the unreacted section, which slows heat flow out of the section. This relation is similar to what is observed in powder compacts, where an increase in particle size decreases propagation velocity. In powder compacts, this behavior is due to a decrease in packing density and therefore a decrease in interface area between particles.

FIG. 13 shows a significant increase in efficiency as the substrate thickness approaches 0 μm, which also decreases the ignition time. This confirms that the substrate is a major source of parasitic heat loss in the model, in comparison to heat losses due to preheating of unreacted sections along the length of the model. In other embodiments of the present invention, instead of RM on a substrate, a free-standing structure can be used to avoid unnecessary heat and efficiency loss.

The simulations show very similar results for the base, equal interconnect length, and continuous interconnect geometries. In the equal interconnect model all interconnects have a length of 160 μm. The average ignition time of the continuous interconnect is 5.45 ms, an increase of 0.279 ms over the ignition time of the base model while the efficiency drops by 0.74%. In addition, the continuous interconnect simplifies fabrication significantly by removing the need for an extra mask during fabrication. However, it is unknown whether the ignition time will continue to decrease or plateau and hence the continuous interconnect model is of interest.

Refinement of the model includes radiative and convective heat losses and temperature dependent physical properties. Diffusion dependent heat generation and accounting for phase changes may also be added to the model to more realistically simulate propagation in the reactive multilayers. In addition to the potential bimetallic systems listed above, the Ti/2B system is a good candidate to use in place of Ni/Al, having already seen widespread use in powder compact time delays. The substrate, despite having a low thermal conductivity, is a significant source of heat loss in the model as can be seen by looking at the efficiency of the model without a substrate. Alternate geometries that are free standing and thus lack the need for a supporting substrate would likely improve performance.

The simulation's results suggest that a time delay structure consisting of alternating sections of Ni/Al multilayers and inert Al interconnects is viable. The ability to engineer a thermal resistance to replace the thermal resistance of surface oxides and thermal contact resistance allows separation and fine control over the factors that drive intermixing in multilayers and ignition. Average ignition times and propagation velocities were observed in the range of 2.09 μm to 6.83 μm and 5.03 cm/s to 15.45 cm/s, respectively. Under most conditions, with the exception of the RM thickness variations, average ignition time and average efficiency are inversely related, and both factors require consideration during optimization. 35.5% efficiency is the lower limit required for propagation in the model.

With respect to another embodiment of the delay material, the invention includes a patterned RM with controlled discontinuities. These discontinuities can be in the form of gaps or regions of very narrow thickness between RM segments created when the RM is deposited on a patterned substrate such as flat substrate with regular impressions or a discontinuous substrate such as a 2-dimensional mesh. One must balance a trade-off between the frequency of the breaks in the RM, that are controlled by the mesh spacing, for example, and the heat transfer to the mesh that is controlled by the diameter, thermal conductivity, and heat capacity of the wire forming the mesh, for example, to avoid quenching as one slows the reaction propagation through mesh design. The thickness of the substrate (diameter of the wire used to make the mesh), its thermal conductivity and heat capacity, and the spacing of the discontinuities in the RM can be varied to control the time and the performance of the delay.

The novelty of the delay material, in which an RM is deposited on a patterned substrate such as a mesh, is the design, creation, and use of a periodic structure in which the propagation of an exothermic reaction is discontinuous. In these materials, the reactions propagate rapidly in small segments of RM, but do not propagate in a continuous manner from one segment to another. Instead, the reaction must be re-ignited in each new segment. The time required for one segment to heat a subsequent segment to the point of ignition produces a chemical time delay with a reproducible and controlled time delay ranging from 100's of microseconds to 10's of seconds for a given length, such as chemical time delays with a length range of 0.25 inches to 2.0 inches. An exothermic reaction propagates through this structure by one segment reacting and getting hot, heating an adjoining segment to a pre-designed ignition temperature, and then repeating this three-step sequence of reacting, heating, and ignition. The final structure, its application, and its controllable design are likely to be unique.

In an exemplary implementation of the RM with controlled discontinuities, nylon meshes of 25, 50, 75, and 100 μm are tested. This exemplary implementation is meant to be illustrative, and is not to be considered limiting. Any implementation of the present invention, known to or conceivable to one of skill in the art could also be employed. The thickness of the RMs are 20 and 40 μm. All RMs have a 90 nm bilayer thickness and a 1:1 Al—Zr chemistry. Al:Zr is not meant to be considered limiting and is used simply by way of example. Al:Zr is stable over time with moderate heat exposure and it has a slower (2.5×) reaction velocity than Al:Ni.

Figure 17:
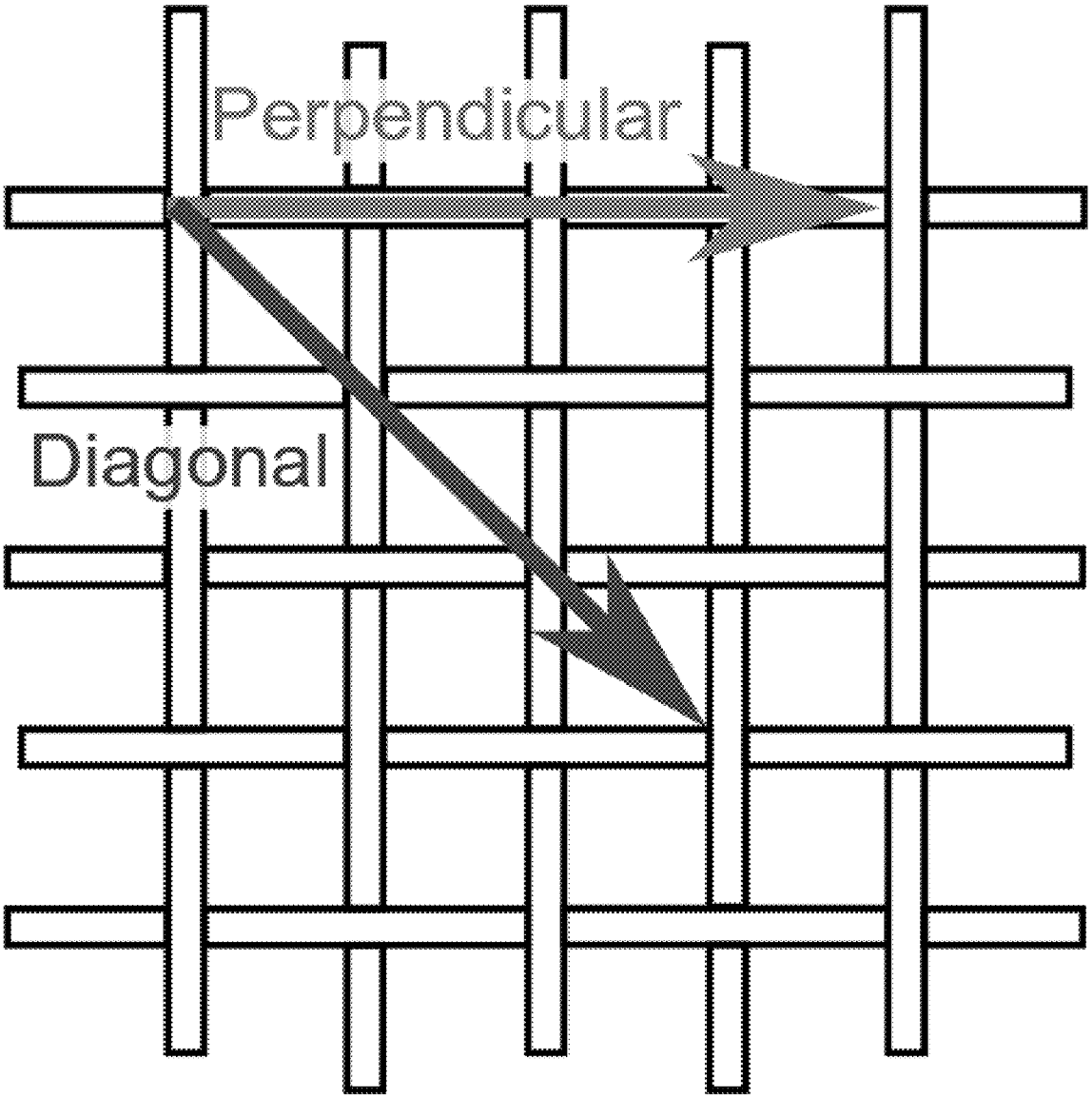
FIG. 17 illustrates a schematic view of mesh designations on a square mesh, used herein.

FIG. 17 illustrates a schematic view of mesh designations, used herein. Mesh size depends on a diameter of the wire used as a base, as well as the mesh design. The mesh designations herein are given by the diameter of the wire.

Figures 18A, 18B, 18C:
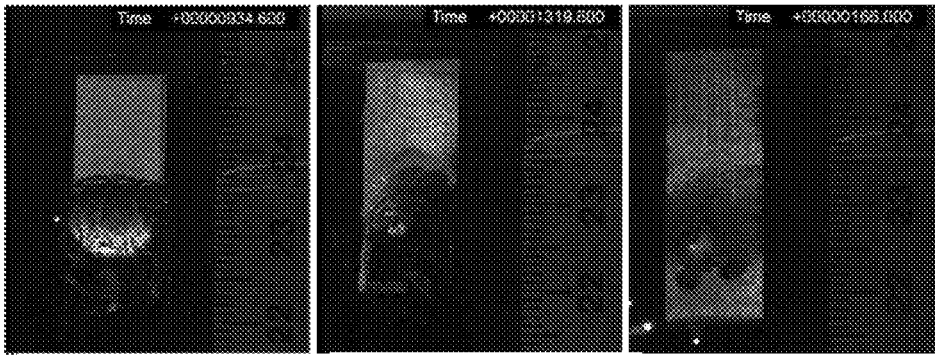
FIGS. 18A-18C illustrate the reactions of exemplary RMs on varying mesh sizes according to an embodiment of the present invention. Each shows the reaction of 40 μm of Al:Zr deposited onto a square weave of various mesh sizes, and the propagation rates perpendicular to the weave were measured.

FIGS. 18A-18C illustrate the reactions of exemplary RMs on varying mesh sizes according to an embodiment of the present invention. Each shows the reaction of 40 μm of Al:Zr deposited onto a square weave of various mesh sizes, and the propagation rates perpendicular to the weave were measured. FIG. 18A shows a 50 μm mesh, which propagated at 1.3 mm/s. FIG. 18A shows a 75 μm mesh, which propagated at 0.9 mm/s but eventually quenches. FIG. 18C shows a 100 μm mesh, which did not propagate. The mesh acts as a heat sink and slows the reaction. The thicker the wire used to form the mesh, the greater the heat sinking effect and segment spacing. The material used for the mesh will also play a large role based on differences in thermal conductivity and if the mesh undergoes a phase transformation at temperatures reached during reaction.

Figure 19A:
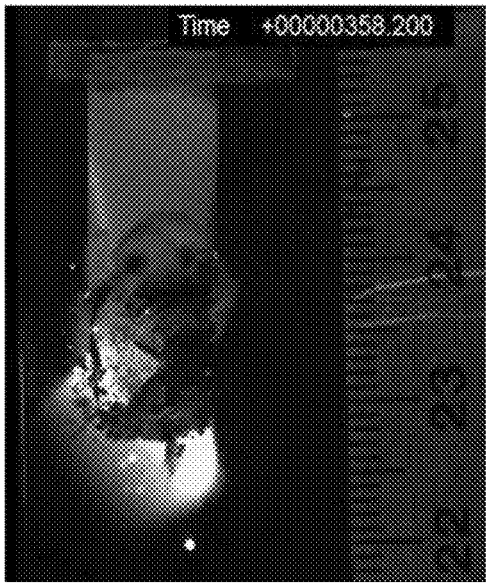
FIGS. 19A- and 19B illustrate the reactions of exemplary RMs with varying thicknesses according to an embodiment of the present invention. Both are Al:Zr deposited onto 25 μm herringbone meshes, propagating perpendicular to the weave. The RM in FIG. 19A is 40 μm thick and propagates at 2.5 mm/s. The RM in FIG. 19B is 20 μm thick and does not propagate.
Figure 19B:
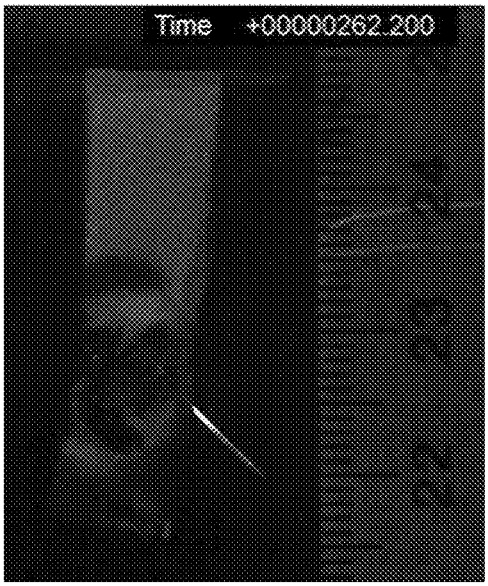

FIGS. 19A- and 19B illustrate the reactions of exemplary RMs with varying thicknesses according to an embodiment of the present invention. Both are Al:Zr deposited onto 25 μm herringbone meshes, propagating perpendicular to the weave. The RM in FIG. 19A is 40 μm thick and propagates at 2.5 mm/s. The RM in FIG. 19B is 20 μm thick and does not propagate.

Figure 20A:
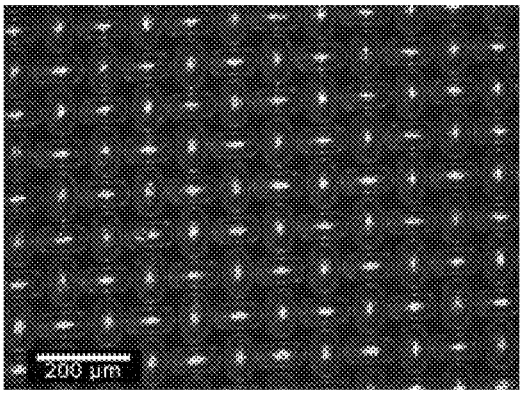
FIGS. 20A-20C illustrate image views of the effect of mesh wire diameter for square meshes, according to an embodiment of the present invention. The mesh wire diameters are 50 μm, 75 μm, and 100 μm, respectively.
Figure 20B:
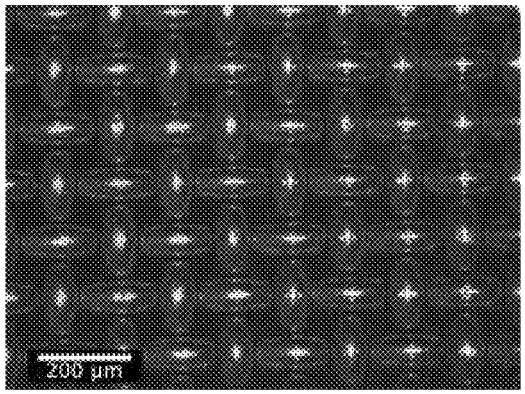
Figure 20C:
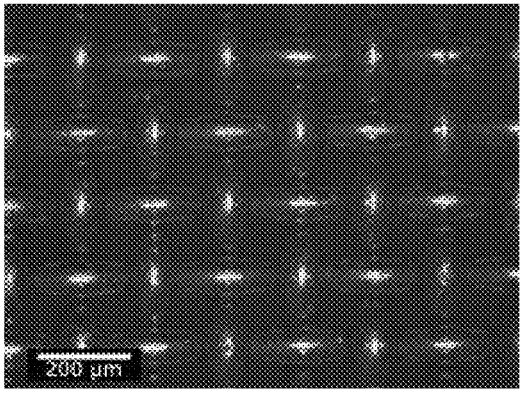

FIGS. 20A-20C illustrate image views of the effect of mesh wire diameter for square meshes, according to an embodiment of the present invention. The mesh wire diameters are 50 μm, 75 μm, and 100 μm, respectively. For a square weave, the wire diameter dictates the segment dimensions and hole size. Theoretically, the RM segment width is equal to the wire diameter, its length is 3× the wire diameter, and the hole is a square with each side length equal to the wire diameter. In reality, the buildup of RM on the mesh is not strictly limited to these dimensions since it can stick to the sides of the wires as well, so the RM is typically wider than the wire diameter, and this effect is more exaggerated for small wire diameters due to their higher relative surface area. Therefore, the RMs deposited onto smaller mesh sizes have more contact between segments and smaller holes relative to the size of each segment. This leads to faster propagation for smaller mesh sizes.

Figure 21A:
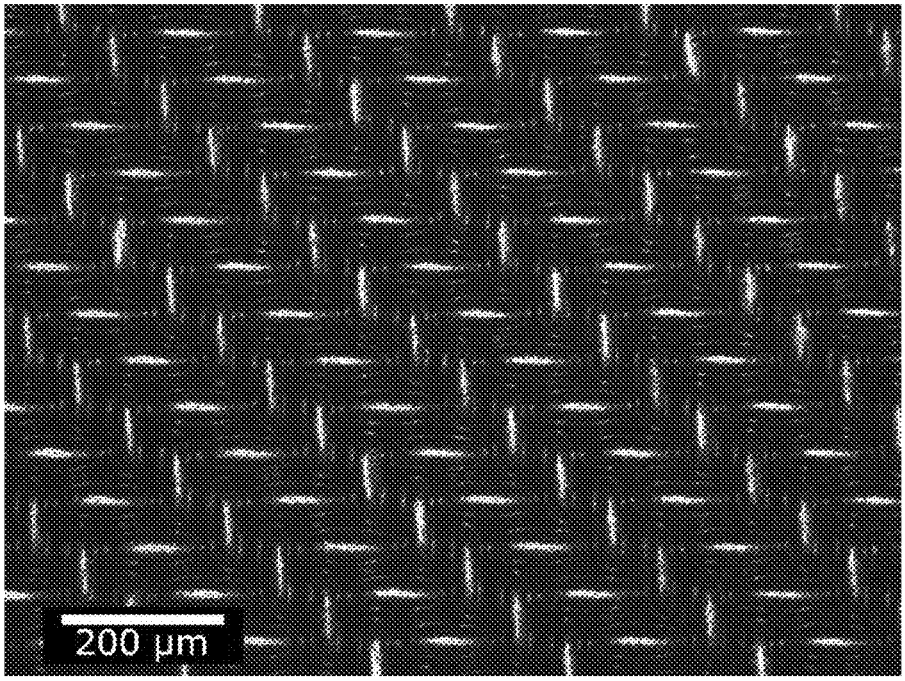
FIGS. 21A and 21B illustrate image views of herringbone (25 μm) vs. square nylon mesh (50 μm), as a base for the RM.
Figure 21B:
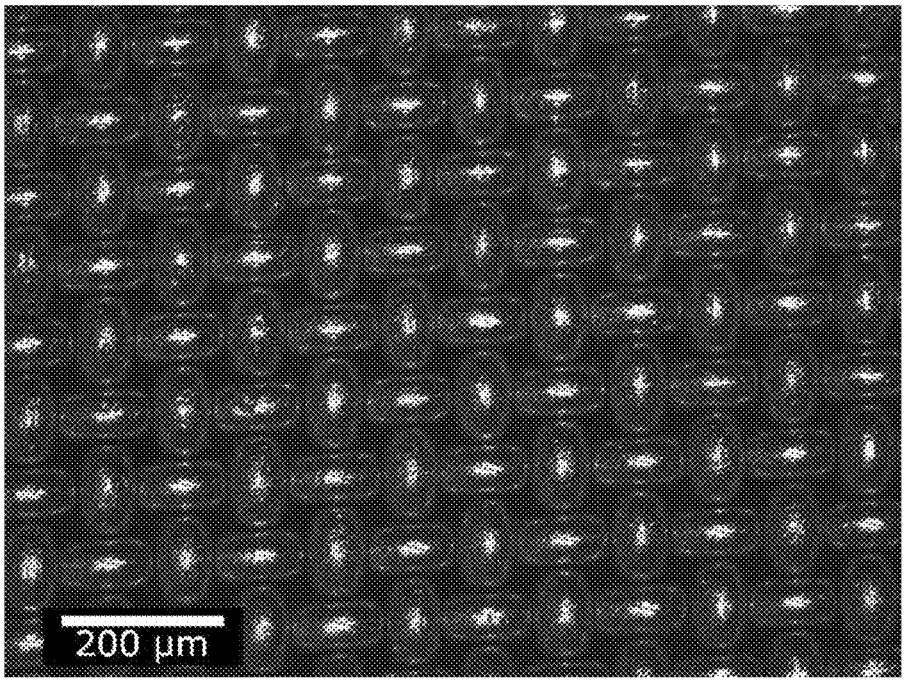

FIGS. 21A and 21B illustrate image views of herringbone (25 μm) vs. square nylon mesh (50 μm), respectively, as a base for the RM. The segment lengths in the 25 μm herringbone mesh are similar to those of the 50 μm square mesh illustrated due to the over-over-under wire pattern of the herringbone weave. The herringbone weave also significantly reduces the area of holes in the mesh.

Figure 22A:
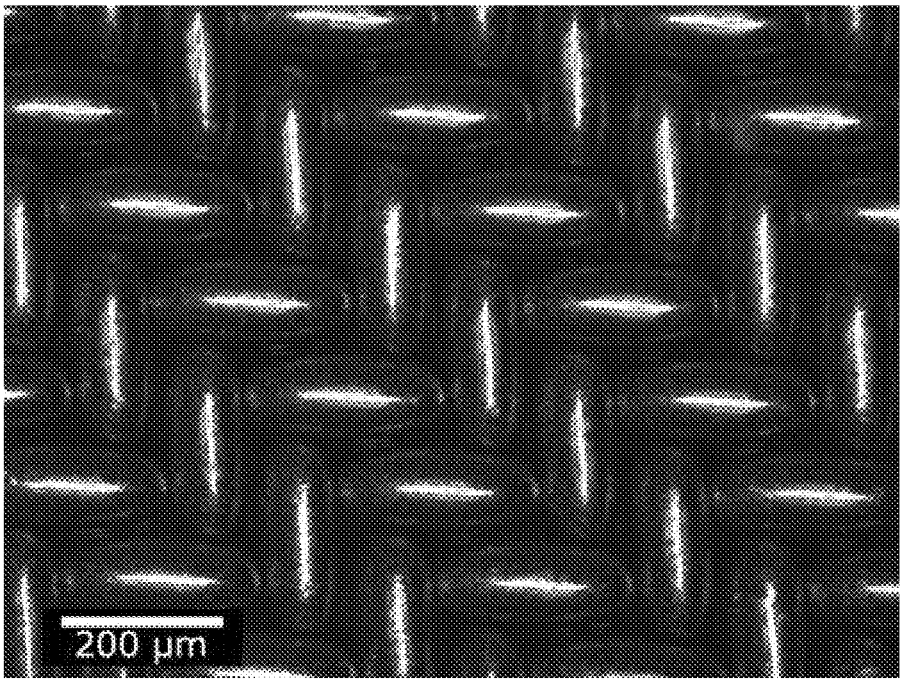
FIGS. 22A and 22B illustrate herringbone mesh geometry for various RM thicknesses; 20 μm and 40 μm, respectively.
Figure 22B:
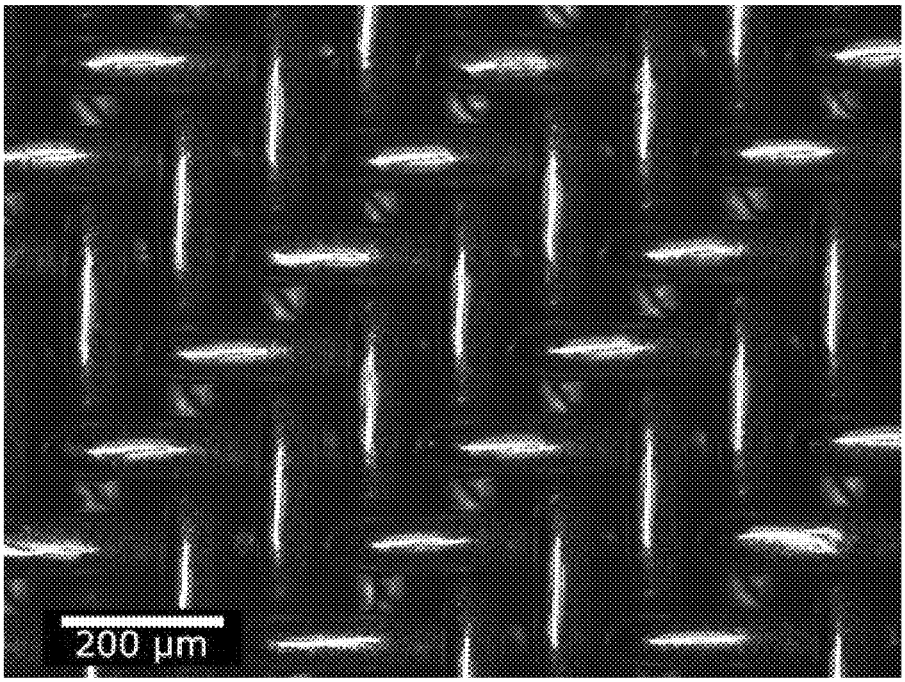

FIG. 22A illustrates a 40 μm thick coating and FIG. 22B illustrates a 20 μm thick coating, both on 25 μm herringbone meshes. A thicker coating on a smaller diameter mesh loses a smaller fraction of its total heat of reaction into the nylon mesh and has smaller gaps at intersections of coated fibers, as illustrated in FIG. 20A. A thinner coating on a larger diameter mesh loses a larger fraction of its total heat of reaction into the nylon mesh and has larger gaps at the intersections of coated fibers, as illustrated in FIG. 20B.

Figure 23:
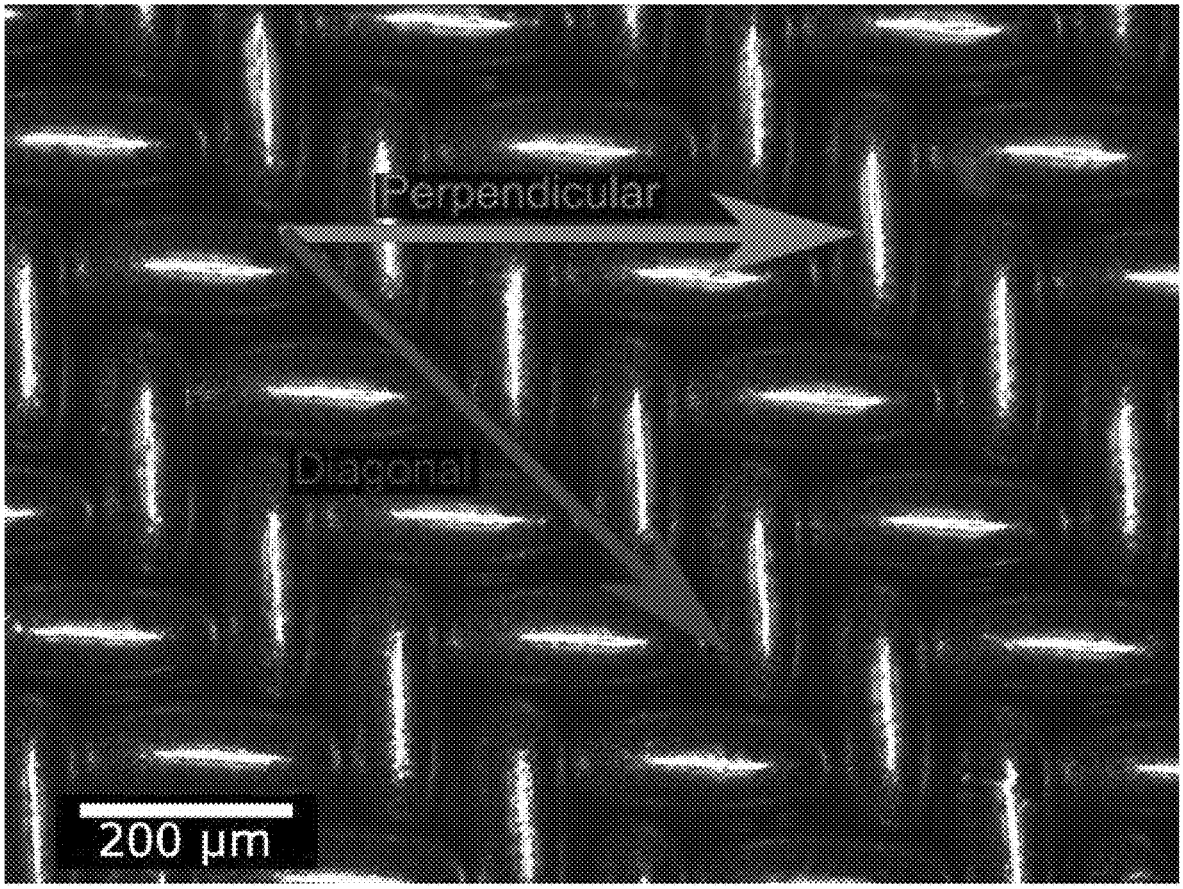
FIG. 23 illustrates propagation direction across the RM deposited onto a mesh with a herringbone weave.
Figure 24A:
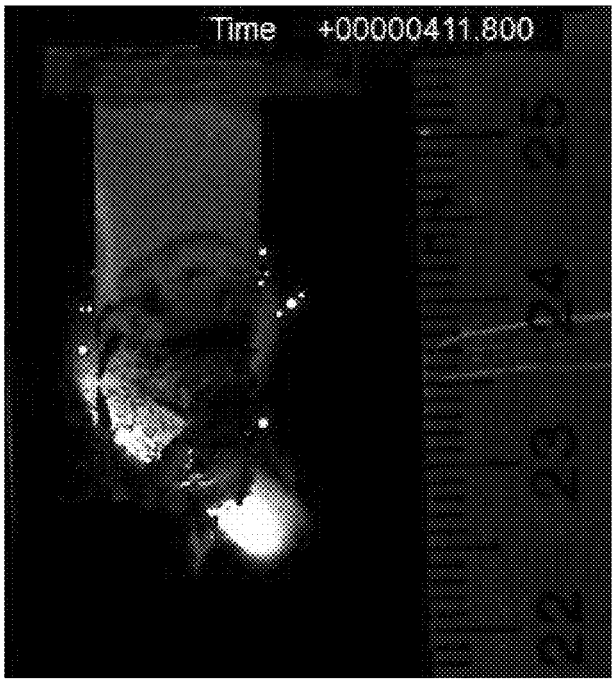
FIGS. 24A and 24B illustrate the impact of propagation direction on reaction velocity within the RMs. Both are 40 μm thick Al:Zr deposited onto a 25 μm herringbone mesh.
Figure 24B:
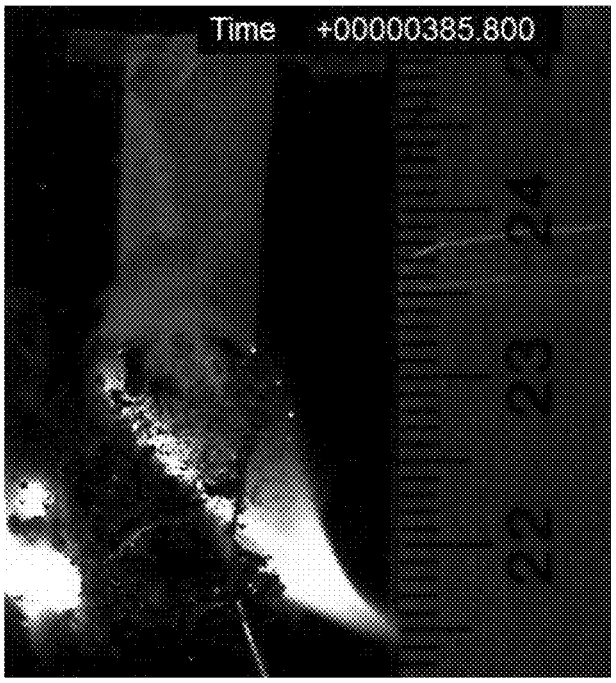

FIG. 23 illustrates propagation direction across the RM deposited onto a mesh with a herringbone weave. FIGS. 24A and 24B illustrate the impact of propagation direction on the RMs. FIG. 24A illustrates a 25 μm mesh with a 40 μm thick coating and a reaction rate of 2.5 mm/s with propagation perpendicular to the weave direction. FIG. 24B illustrates a 25 μm mesh with a 40 μm thick coating and a reaction rate of 2.9 mm/s with propagation diagonal to the weave direction. This RM and orientation was the fastest propagating combination tested.

Figure 25:
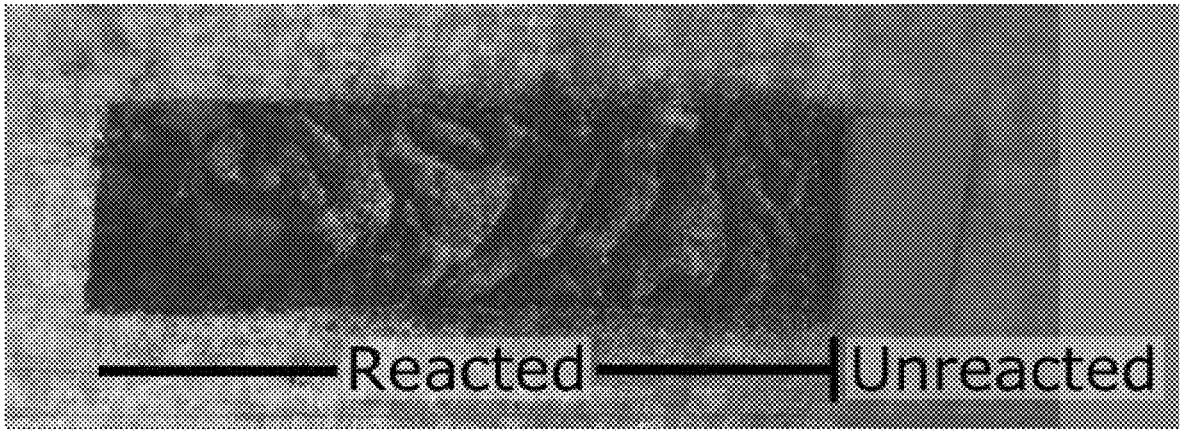
FIG. 25 illustrates an image view of an RM with one end enclosed between glass slides wherein its propagating reaction quenches when it reaches the enclosure, according to an embodiment of the present invention.

FIG. 25 illustrates an image view of an RM that quenches when enclosed, according to an embodiment of the present invention. The RM was ignited from the left side, which was open to air, and it propagates to the right until it reaches a segment where the mesh was clamped between two glass slides. The reaction quenched at this interface.

Figure 26A:
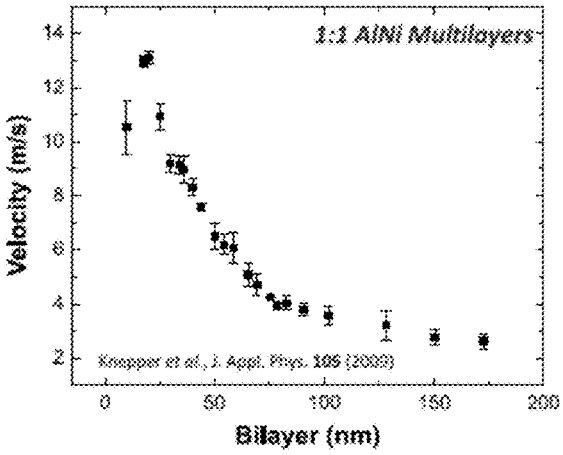
FIGS. 26A and 26B illustrate graphical views of chemistry and bilayer period on reaction velocity within continuous RMs, according to an embodiment of the present invention.
Figure 26B:
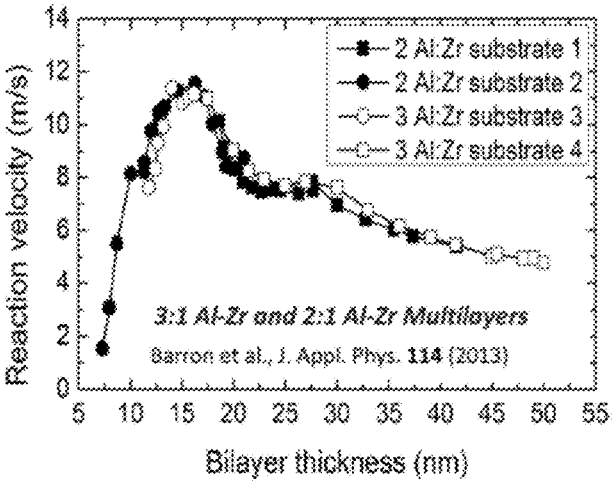

FIGS. 26A and 26B illustrate graphical views of chemistry and bilayer period on reaction velocity, according to an embodiment of the present invention. Reaction velocities are higher for 1:1 Al—Ni than 3:1 Al:Zr. However, Al:Zr RMs are less susceptible to aging for the same bilayer thickness. 1:1 Al:Zr is 2× slower than 3:1 3Al:Zr or 2:1 2Al:Zr RMs for given bilayer thickness. Reaction velocity scales inversely with bilayer thickness (reactant spacing). Velocities in free-standing or bare RMs can be increased from 1.6 m/s to 12 m/s.

With respect to the chemical time delay that includes an embodiment of the delay material, a patterned RM with controlled discontinuities in the RM is placed within a tube that is sealed at either end. Small pieces of continuous RMs or powder compacts are placed at either end to ensure ignition of and output from the delay. Typically, two strips of the patterned RM are placed facing each other, within the delay, to provide redundancy.

The discontinuities within the RM can be in the form of lithographically patterned breaks between segments of RMs that are connected by an inert material such as Al on a continuous substrate with low thermal conductivity, or they can be in the form of gaps between RM segments created when the RM is deposited on a patterned substrate such as flat substrate with regular impressions or a discontinuous substrate such as a 2-dimensional mesh. For the lithographically patterned delays, a Finite Element Method (FEM) can be applied to predict heat conduction in the structure under varying geometric and thermophysical conditions. At least three variables can be altered to control the time and performance of the delays: the heat transfer efficiency between the reacting and unreacted material, the ignition temperature for the RM, and the average propagation velocity within the continuous reactive segments. The heat transfer efficiency must be high enough (>35%) to ensure that the exothermic, chemical reactions in the delays can self-propagate and not quench. One must balance a trade-off between the length of the time delay and the efficiency of the heat transfer for all geometric and thermal-physical parameters. For the delays formed by depositing on a discontinuous substrate, such as a nylon mesh, the thickness of the substrate (size of the wire used to make the mesh), its thermal conductivity and heat capacity, and the spacing of the discontinuities in the RM can be varied to control the time and the performance of the delay.

Figure 27A:
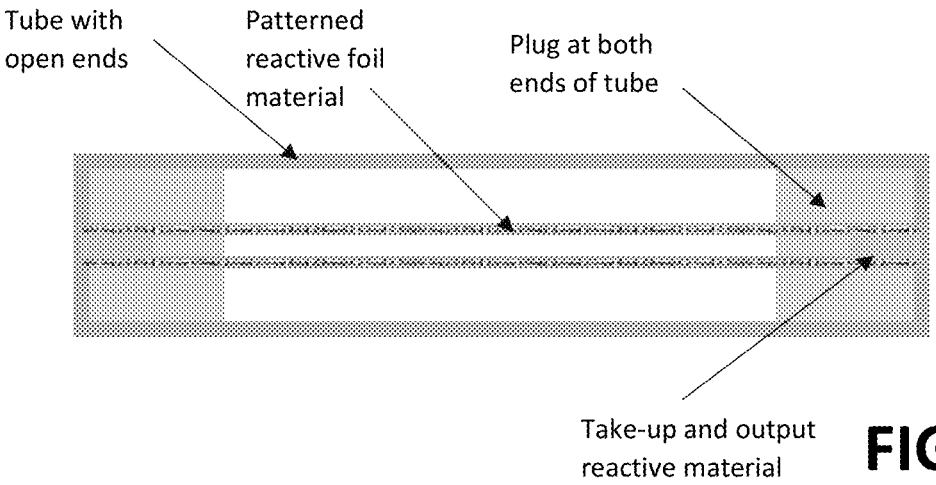
FIGS. 27A and 27B illustrate schematic views of the time delay, according to an embodiment of the present invention.
Figure 27B:
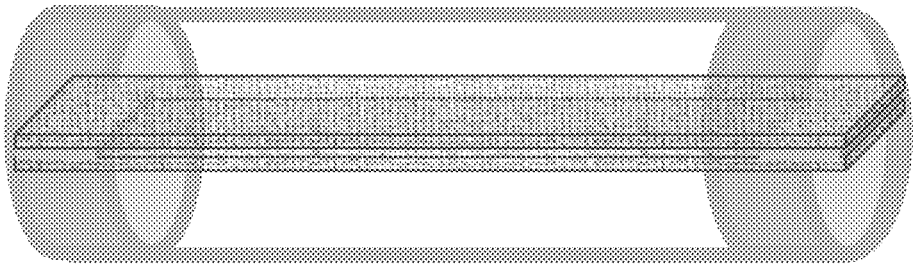

FIGS. 27A and 27B illustrate a schematic view of the time delay, according to an embodiment of the present invention. The invention presented here, illustrated in FIGS. 27A and 27B is a patterned RM with controlled discontinuities in the RM, placed within a tube that is sealed at either end. Small pieces of continuous RMs or powder compacts are placed at either end to insure ignition of and output from the delay. Typically, two strips of the patterned RM are placed facing each other, within the delay, to provide redundancy.

The novelty is the design, creation, and use of a chemical time delay that includes a periodic structure in which small segments of RM are separated from each other to produce a chemical time delay with a reproducible and controlled time delay ranging from 100's of microseconds to 10's of seconds for a given length, such as chemical time delays with a length range of 0.25 inches to 2.0 inches. An exothermic reaction propagates through this structure by one segment reacting and getting hot, heating an adjoining segment to a pre-designed ignition temperature, and then repeating this three-step sequence of reacting, heating, and ignition. The final structure, its application, and its controllable design are likely to be unique. The delay will be environmentally friendly and reproducible.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

The invention claimed is:

1. A material for manipulating propagation rates of an exothermic reaction comprising:

a reactive material, wherein the reactive material is configured for discontinuous propagation.

2. The material of claim 1 wherein patterned breaks are connected by an inert material.

3. The material of claim 1 further comprising a tube that is sealed at both ends, wherein the reactive material is reacted within the tube.

4. The material of claim 1 wherein a thickness of the reactive material is varied to manipulate the propagation rate.

5. A material for manipulating propagation rates of an exothermic reaction comprising:

a reactive material, wherein the reactive material comprises discontinuities; and wherein the discontinuities comprise patterned breaks between a first segment of the reactive material and a subsequent segment of the reactive material, and wherein the patterned breaks are patterned lithographically.

6. The material of claim 5 wherein patterned breaks are connected by an inert material.

7. The material of claim 5 further comprising a tube that is sealed at both ends, wherein the reactive material is reacted within the tube.

8. The material of claim 5 wherein a thickness of the reactive material is varied to manipulate the propagation rate.

9. A material for manipulating propagation rates of an exothermic reaction comprising:

a reactive material, wherein the reactive material comprises discontinuities; and wherein the discontinuities comprise patterned breaks between a first segment of the reactive material and a subsequent segment of the reactive material, and wherein the patterned breaks are patterned mechanically.

10. The material of claim 9 wherein patterned breaks are connected by an inert material.

11. The material of claim 9 further comprising a tube that is sealed at both ends, wherein the reactive material is reacted within the tube.

12. The material of claim 9 wherein a thickness of the reactive material is varied to manipulate the propagation rate.

13. A device for manipulation of propagation rates of an exothermic reaction comprising:

a substrate; and a reactive material reacted on the substrate, wherein the reactive material comprises discontinuities, and wherein the discontinuities comprise breaks between a first segment of the reactive material and a subsequent segment of the reactive material, and wherein the breaks are patterned lithographically.

14. The device of claim 13 wherein patterned breaks are connected by an inert material.

15. The device of claim 13 wherein the substrate has a low thermal conductivity.

16. The device of claim 13 wherein the device includes a tube that is sealed at both ends, wherein the reactive material is reacted within the tube.

17. The device of claim 13 wherein a thickness of the reactive material is varied to manipulate the propagation rate.

18. A device for manipulation of propagation rates of an exothermic reaction comprising:

a substrate; and a reactive material reacted on the substrate, wherein the reactive material comprises discontinuities, and wherein the discontinuities comprise breaks between a first segment of the reactive material and a subsequent segment of the reactive material, and wherein the breaks are patterned mechanically.

19. The device of claim 18 wherein patterned breaks are connected by an inert material.

20. The device of claim 18 wherein the substrate has a low thermal conductivity.

21. The device of claim 18 wherein the device includes a tube that is sealed at both ends, wherein the reactive material is reacted within the tube.

22. The device of claim 18 wherein a thickness of the reactive material is varied to manipulate the propagation rate.

23. A device for manipulation of propagation rates of an exothermic reaction comprising:

a substrate, wherein the substrate comprises a mesh in which the weave produces discontinuities of the exposed surfaces of the mesh; and a reactive material reacted on the substrate, wherein propagation through the reactive material is discontinuous as a result of the breaks between segments of the mesh.

24. The device of claim 23 wherein patterned breaks are connected by an inert material.

25. The device of claim 23 wherein the substrate's thermal conductivity is varied to tune the propagation through the reactive material.

26. The device of claim 23 wherein the substrate's heat capacity is varied to tune the propagation through the reactive material.

27. The device of claim 23 wherein the substrate's thickness (wire thickness) is varied to tune the propagation through the reactive material.

28. The device of claim 23 wherein the substrate is a polymer mesh.

29. The device of claim 23 wherein the device includes a tube that is sealed at both ends, wherein the reactive material is reacted within the tube.

30. The device of claim 23 wherein a thickness of the reactive material is varied to manipulate the propagation rate.

* * * * *